US006712451B2

(12) United States Patent
Madziarz et al.

(10) Patent No.: US 6,712,451 B2
(45) Date of Patent: Mar. 30, 2004

(54) PRINTHEAD ASSEMBLY WITH SHIFT REGISTER STAGES FACILITATING CLEANING OF PRINTHEAD NOZZLES

(75) Inventors: David S. Madziarz, Bergen, NY (US); David A. Johnson, Rochester, NY (US); Thomas P. Szumla, Lockport, NY (US); Manh Tang, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/091,320

(22) Filed: Mar. 5, 2002

(65) Prior Publication Data

US 2003/0169307 A1 Sep. 11, 2003

(51) Int. Cl.[7] ..... B41J 2/14
(52) U.S. Cl. ..... 347/48; 347/12; 347/22
(58) Field of Search ..... 347/12, 48, 59, 347/22

(56) References Cited

U.S. PATENT DOCUMENTS

| | | | | |
|---|---|---|---|---|
| 4,695,853 A | | 9/1987 | Hackleman et al. | 346/140 |
| 4,751,531 A | | 6/1988 | Saito et al. | 346/140 |
| 4,878,065 A | | 10/1989 | Fukushima et al. | 346/76 |
| 4,882,686 A | | 11/1989 | Gretter | 364/158 |
| 5,148,595 A | | 9/1992 | Dogget et al. | |
| 5,502,471 A | | 3/1996 | Obermeier et al. | 347/65 |
| 5,543,828 A | | 8/1996 | Minowa | 347/195 |
| 5,689,296 A | | 11/1997 | Heitmann et al. | |
| 5,790,140 A | * | 8/1998 | Koizumi et al. | 347/12 |
| 5,838,339 A | | 11/1998 | Silverbrook | 347/9 |
| 5,975,670 A | * | 11/1999 | Kikuta et al. | 347/15 |
| 6,079,821 A | | 6/2000 | Chwalek et al. | 347/82 |
| 6,179,411 B1 | | 1/2001 | Saikawa et al. | 347/48 |
| 6,193,353 B1 | * | 2/2001 | Vives et al. | 347/29 |
| 6,217,163 B1 | | 4/2001 | Anagnostopoulos et al. | 347/75 |
| 6,488,350 B2 | * | 12/2002 | Iwasaki et al. | 347/12 |

FOREIGN PATENT DOCUMENTS

| | | |
|---|---|---|
| EP | 0 692 383 A | 1/1996 |
| EP | 0 934 829 A | 8/1999 |
| EP | 1 177 896 A | 2/2002 |
| WO | 96 32264 A | 10/1996 |

* cited by examiner

*Primary Examiner*—Stephen D. Meier
*Assistant Examiner*—Lam S Nguyen
(74) *Attorney, Agent, or Firm*—Norman Rushefsky

(57) ABSTRACT

An inkjet printhead assembly (50) for an inkjet printer having a printhead (10) with a plurality of nozzles (24) and data path and control electronics circuitry (56) operably coupled with the printhead (10) for providing image data that control the flow of ink through the nozzles (24). The nozzles (24) are arranged in sections with actuators (28*a*, 28*b*) predisposed about each nozzle (24), for causing the nozzles (24) to print. Interconnections (54) between the data path and control electronics circuitry (56) and printhead (10) include DATA, CLOCK, LATCH and ENABLE lines which are used to operate the printhead (10) and, in turn, the nozzles (24) via shift register stages (228). The actuators (28*a*, 28*b*) are supported by the shift register stages (228) into which data is shifted from register stage to register stage for loading data that enables the actuators (28*a*, 28*b*). The shift registers stages (228) for all actuators (28*a*, 28*b*) are located to one side of the print head (10) to facilitate cleaning of the nozzles (24).

17 Claims, 14 Drawing Sheets

SEE FIG. 5
28a1
28b1
28a2
28b2
28aN
28bN
28aN+1
28bN+1
28aN+2
28bN+2
28a2N
28b2N
86
88
90
91
92
94
100
102
104
106
80
UPPER_ENABLE
LOWER_ENABLE
UPPER_LATCH
LOWER_LATCH
DATA U 0
UPPER_CLOCK
DATA U 1
DATA U M
DATA L 0
LOWER CLOCK
DATA L 1
DATA L M
N-bits SERIAL SHIFT REGISTER M
N-bits SERIAL SHIFT REGISTER 1
N-bits SERIAL SHIFT REGISTER 0
S1
S2
SN

PRINTHEAD ASSEMBLY WITH SHIFT REGISTER STAGES FACILITATING CLEANING OF PRINTHEAD NOZZLES

CROSS-REFERENCE TO RELATED APPLICATION

This application is related to application Ser. No. 09/960,109, filed Sep. 21, 2001, entitled "Printhead Assembly With Minimized Interconnections to an Inkjet Printhead," the entirety of which is incorporated herein by reference.

FIELD OF THE INVENTION

The invention relates in general to a recording apparatus such as, in a preferred example, a printhead and, more specifically, to a printhead assembly that facilitates cleaning of the printhead. More particularly, the invention relates to a printhead assembly having a printhead with a plurality of shift register stages supporting a plurality of actuators, the shift registers stages being located on one side of the recording elements of the printhead, such as inkjet nozzles, to facilitate cleaning of the printhead's nozzles.

BACKGROUND OF THE INVENTION

Without limiting the scope of the invention, its background is described in connection with thermal inkjet printers, as an example. Modern printing relies heavily on inkjet printing techniques. The term "inkjet" as utilized herein is intended to include all drop-on-demand or continuous inkjet printer systems including, but not limited to, thermal inkjet, piezoelectric, and continuous, all of which are well known in the printing industry. Essentially, an inkjet printer produces images on a receiver medium, such as paper, by ejecting ink droplets onto the receiver medium in an image-wise fashion. The advantages of non-impact, low-noise, low-energy use, and low cost operation, in addition to the capability of the printer to print on plain paper, are largely responsible for the wide acceptance of inkjet printers in the marketplace.

The printhead is the device that is most commonly used to direct the ink droplets onto the receiver medium. A printhead typically includes an ink reservoir and channels which carry the ink from the reservoir to one or more nozzles. Typically, sophisticated printhead systems utilize multiple nozzles for applications such as high-speed continuous inkjet printer systems, as an example. Continuous inkjet printhead device types include electrostatically controlled printheads and thermally steered printheads. Both printhead types are named according to the means used to steer ink droplets ejected from nozzle openings.

It is well known in the art of inkjet printing that multiple actuators or heating elements per inkjet nozzle can be used. For example, U.S. Pat. No. 4,751,531 describes the use of a two heater printing nozzle while U.S. Pat. No. 4,695,853 describes the use of a vertical array of 9 heating elements per nozzle. In order to optimize drop formation conditions, it is preferred to utilize independent control circuits for such multi-actuator print nozzle configurations.

Inks for high speed ink jet printers, whether of the continuous or drop-on-demand type, must have a number of special characteristics. For example, the ink should incorporate a nondrying characteristic, so that drying of ink in the ink ejection chamber is hindered or slowed to such a state that by occasional spitting of ink droplets, the cavities and corresponding nozzles are kept open. The addition of glycol facilitates free flow of ink through the inkjet chamber. Of course, the inkjet printhead is exposed to the environment where the inkjet printing occurs. Thus, the previously mentioned nozzles are exposed to many kinds of air born particulates. Particulate debris may accumulate on surfaces formed around the nozzles and may accumulate in the nozzles and chambers themselves. That is, the ink may combine with such particulate debris to form an interference burr that blocks the nozzle or that alters surface wetting to inhibit proper formation of the ink droplet. The particulate debris should be cleaned from the surface and nozzle to restore proper droplet formation. In the prior art, the cleaning mechanism may consist of a brush, wiper, sprayer, vacuum suction device, and/or spitting of ink through the nozzle.

At the same time, there are practical space limitations with respect to the number of layers necessary to implement the control circuits as well as limitations in the number of interconnections that are practical in order to make the design useful and operable. These type of design constraints require the use of serial shift registers to bring the print data to the printhead during printing. Between the stated design constraints lies an optimum solution for maintaining of clean multi-actuated printheads.

Thus, inkjet printers can be said to have the following problems: the inks tend to dry-out in and around the nozzles resulting in clogging of the nozzles; cleaning nozzles that have limited accessibility due to the placement of the control electronics poses extra demands on the design of printhead assembly as well as the cleaning members used.

Accordingly, what is needed is a way of organizing the printhead assembly such that minimal interference with cleaning is facilitated. A printhead assembly that arranges the shift register stages and actuators to facilitate cleaning of the nozzles would provide numerous advantages.

SUMMARY OF THE INVENTION

The present invention provides a solution to dealing with the task of cleaning a multi-actuated configuration printhead that has limited space due to the control electronics. The invention provides a printhead assembly with the control circuitry advantageously placed to facilitate cleaning of the printhead assembly.

Therefore, according to one embodiment, disclosed is an inkjet printhead comprising a plurality of nozzles arranged in an array for ejecting ink to form an image on a receiver member and a plurality of actuators associated with each respective nozzle, each actuator being separately drivable to affect ejection of ink from the respective nozzle. The printhead further comprises a plurality of shift registers stages, each stage being associated with a respective nozzle actuator and nozzle actuators associated with each nozzle being associated with different shift register stages. A cleaning assembly is provided for cleaning the nozzles. The shift register stages being adapted to shift data from one stage to a next stage to distribute data to the different stages, wherein the shift register stages are arranged to facilitate cleaning of the plurality of nozzles. According to one specific embodiment, the shift register stages are positioned on the same side of the printhead thereby providing sufficient space for the cleaning mechanism and the nozzles to be moved relative to each other.

Further disclosed is an inkjet printhead assembly comprising a plurality of nozzles having corresponding nozzle openings for delivering ink onto a specified receiver medium and a plurality of shift registers operably coupled to a plurality of actuators associated with said nozzles and adapted to cause ink to be delivered through said nozzles openings in the direction of said receiver medium. The printhead assembly further comprises print data drivers operably coupled to the plurality of shift registers via a plurality of interconnections, wherein said shift registers are arranged all to one side of the nozzles to facilitate cleaning of the plurality of nozzles. In one specific embodiment, the plurality of actuators comprise heaters. In another specific embodiment, the shift registers and their respective electrical interconnections using a wire-bonding technique are positioned on one side of said plurality of nozzles thereby providing sufficient space for the cleaning mechanism to be moved relative to the nozzles.

In accordance with another aspect of the invention, there is provided a method of providing image data in the printer apparatus, the method comprising providing a plurality of recording elements arranged in an array for recording of an image on a receiver medium; providing a plurality of actuators associated with each respective recording element each actuator being separately drivable to affect recording by a respective recording element; providing a cleaning assembly for cleaning the recording elements; providing a plurality of shift register stages, each stage being associated with a respective different actuator, each recording element being associated with plural different shift register stages and shifting data from one stage to a next stage to distribute data to the different stages, the shift register stages and their respective wire-bond interconnects being located all to one side of the array of recording elements; and advancing the cleaning assembly relative to the array of recording elements wherein the shift register stages and their respective wire-bond interconnections are sufficiently positioned away from the recording elements to facilitate cleaning of the recording elements by the cleaning assembly without the cleaning assembly damaging the shift register circuits.

A technical advantage of the present invention is a cost effective method of facilitating cleaning of a printhead assembly in a thermal inkjet printhead.

Another technical advantage includes optimum compromise between the length of shift registers and number of heaters to be controlled. In one printhead configuration, twenty 128-bit shift registers are able to operate a 1280 nozzle assembly.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in these figures refer to corresponding parts in the detailed description unless otherwise indicated.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. For example, the specific embodiments discussed herein are described in the context of nozzles used in an inkjet printhead which act as recording elements for recording images on a receiver medium, such as paper. It should understood, however, that other types of recording elements such as LEDs, thermal recording elements, and lasers, among others may benefit from the advances provided by the invention. The specific examples discussed herein are merely illustrative of specific ways to make and use the invention, and do not delimit the scope or application of the invention.

Figure 1:
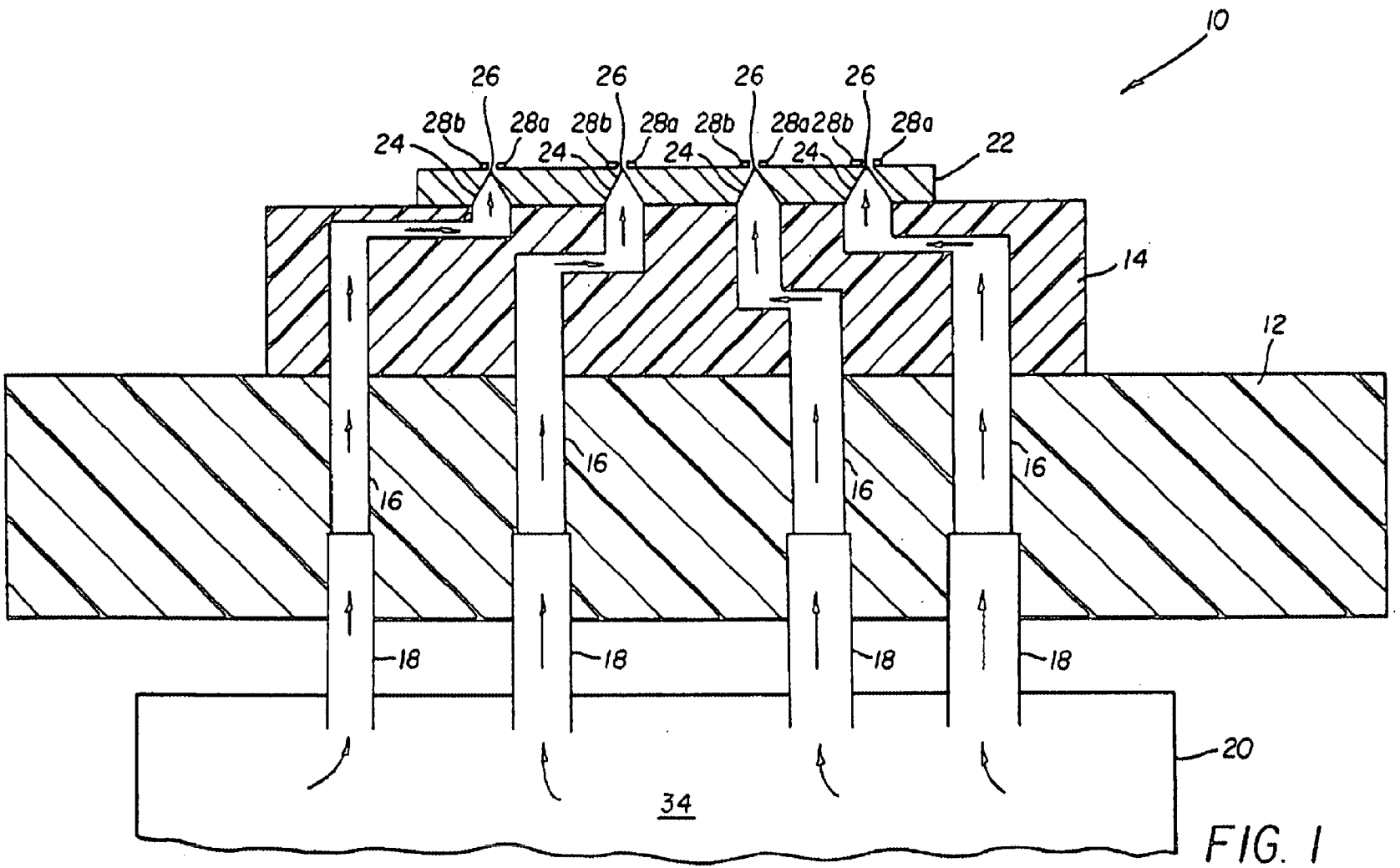
FIG. 1 is a diagram illustrating an inkjet printhead with a plurality of nozzle openings through which ink flows.

Referring to FIG. 1, therein is shown a cross-section of an inkjet printhead 10 of the type commonly employed in thermal inkjet printers. More specifically, inkjet printhead 10 is a device that is commonly used to direct ink droplets or "drops" onto a receiver medium, such as paper, in an inkjet printer (not shown) and comprises one of several types of recording apparatus to which the invention may be applied. With the inkjet printhead 10, ink drops exit rapidly enough so as to form an ink drop stream. The terms "ink drops", "ink droplets", "ink stream", and "ink" will be used interchangeably throughout.

Inkjet printhead 10 includes an ink reservoir 20, fluid-flow channels 18 and inlet/outlet tubes 16 which carry the ink 34 from the reservoir 20 to one or more recording elements or nozzles 24. For convenience and conformity to the figures, the term "nozzles" will be used throughout although it should be understood that nozzle comprises but a single type of recording element to which the invention may be applied. Inkjet printhead 10 also comprises a mounting block 12, a manifold 14, and a substrate 22 which internally define the tubes 16 and fluid flow channels 18, providing paths from the ink reservoir 20 to the nozzles 24. Typically, the number of nozzles 24 is numerous providing an inkjet printhead with as many as 160, 320 or 1,280 nozzles, according to the design resolution and quality of printhead assembly. Typically, the nozzles may be positioned at 300 dots per inch or higher resolution. Those skilled in the art will, appreciate that the figures are not drawn to scale and have been enlarged in order to illustrate the major aspects of the inkjet printhead 10.

Some inkjet printheads are made using thermally steered ink drop technology. As such, thermally steered inkjet printheads utilize thermal means to steer a continuous stream of ink drops ejected from each of a plurality of nozzle openings 26 in the inkjet printhead 10. Each of the nozzle openings 26 is also referred to as an "orifice" or a "bore" in the art. For thermal steering, inkjet printhead 10 includes a plurality of upper heaters 28*a* and lower heaters 28*b* (also known as actuators), located about the nozzle openings 26 to permit thermal steering. Specifically, each pair of heaters 28*a*, 28*b* are predisposed about a single nozzle opening 26 for directing the flow of ink drops 34 through the nozzle openings 26. For simplicity, the terms "heater" and "heaters", "actuator" and "actuators", will be used interchangeably and to refer to the singular and plural form of the corresponding part. For reference, U.S. Pat. No. 6,079,821 describes the operation of such a thermally steered inkjet printing in detail. Commonly assigned U.S. application Ser. No. 09/607,840, filed in the name of Lee et al, describes the operation of thermally steered drop-on-demand inkjet printing.

Figure 2:
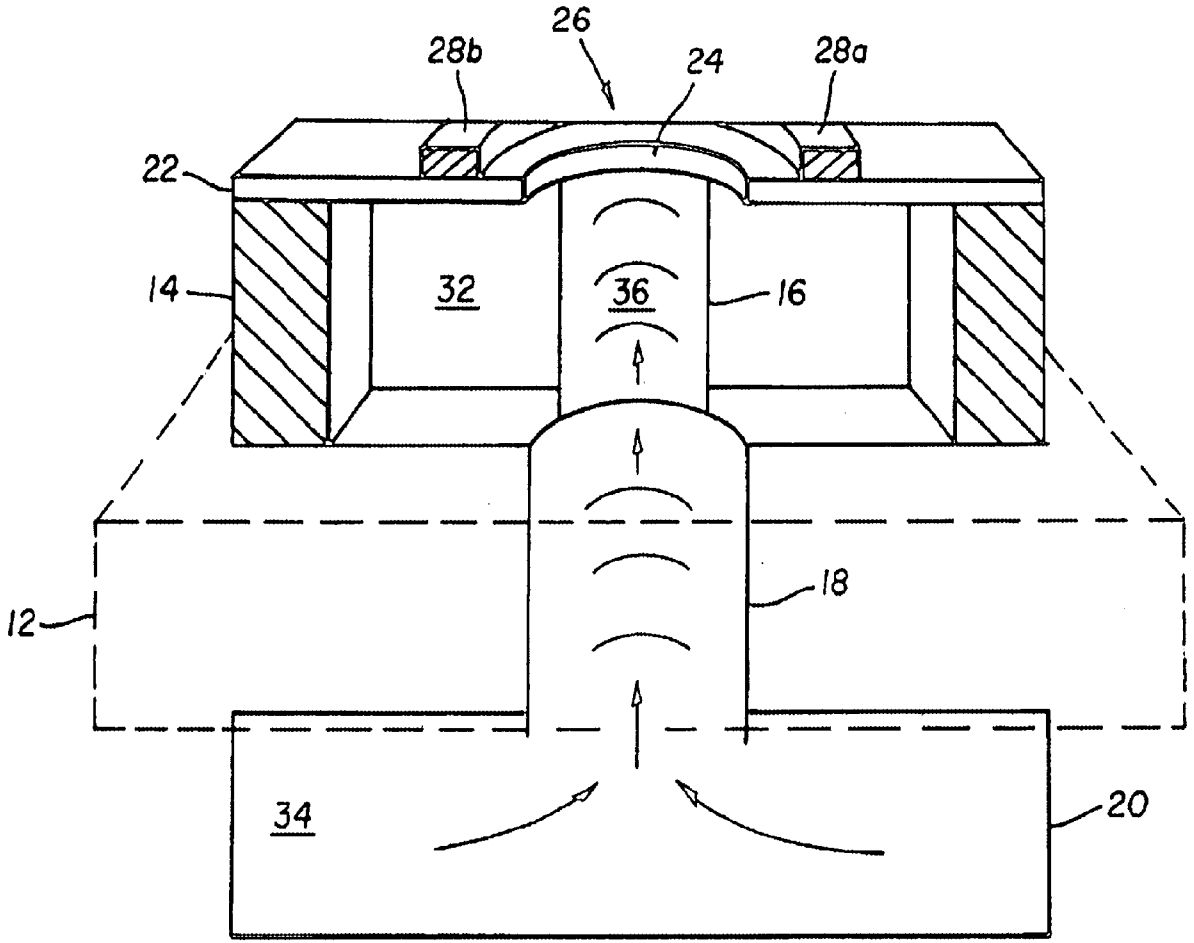
FIG. 2 illustrates a single printhead nozzle with two heater elements.

FIG. 2 is a cross-section view in perspective of a thermally steered inkjet printhead, such as printhead 10, illustrating the use of heaters 28*a*, 28*b*. Substrate 22 is attached to the gasket manifold 14 which, in turn, is bonded to the mounting block 12 in order to form the sub-assembly of inkjet printhead 10. The mounting block 12 and the gasket manifold 14 together form a delivery system wherein fluid flow channels 18 are defined. Each fluid flow channel 18 provides a route for the ink stream 36 to exit the nozzle 24 through openings 26. Predisposed about the nozzle opening 26 are heaters 28*a* and 28*b*, which are used to direct the flow of ink stream 36 through the nozzle opening 26 via thermal deflection.

Typically, heaters 28*a*, 28*b* are arranged in a split-ring fashion about a corresponding nozzle opening 26. That is, heaters 28*a*, 28*b* comprise an upper heater and a lower heater, respectively, that allow for thermal deflection of the ink stream 36 exiting the nozzle opening 26 onto a receiver medium, such as paper. Therefore, if an ink stream 36 directed to the upper direction is desired, the lower heater 28*b* is heated, causing the ink stream 36 to bend in the upper direction. If, however, an ink stream 36 directed to the lower direction is desired, then the upper heater 28*a* is heated, causing the ink stream 36 to bend to the lower direction.

A nozzle 24 comprises a nozzle cavity 32 for facilitating the flow of ink 34 from the reservoir 20. In operation, ink from the nozzle cavity 32 is ejected through the opening 26 and exits as an ink stream 36. At a distance removed from the printhead 10, the ink stream 36 breaks up into ink drops traveling in the same direction as the ink stream 36. Heat pulses applied to one or more heaters 28 cause the ink stream 36 to be directed in a printing direction or in a non-printing direction. Typically, ink is recycled from the non-printing direction using a gutter assembly (not shown) that directs the ink to a recycling unit (not shown). Thus, ink 34 travels from the ink reservoir 20 through the fluid flow channels 18 to the inlet/outlet tubes 16 in order to exit the nozzle openings 26.

The flow of ink through the nozzle opening 26 is facilitated by a print engine including a print data driver that drives each nozzle 24 in order to cause ink to flow through a nozzle opening 26 in the desired direction. The electronics utilized to achieve this function include data path and control electronics that are responsible for generating the print data and controlling the flow of print data from the print engine to the printhead. In the design of a printhead electrical interface, it is desired to minimize the number of signals and interconnections of the interface.

Figure 3:
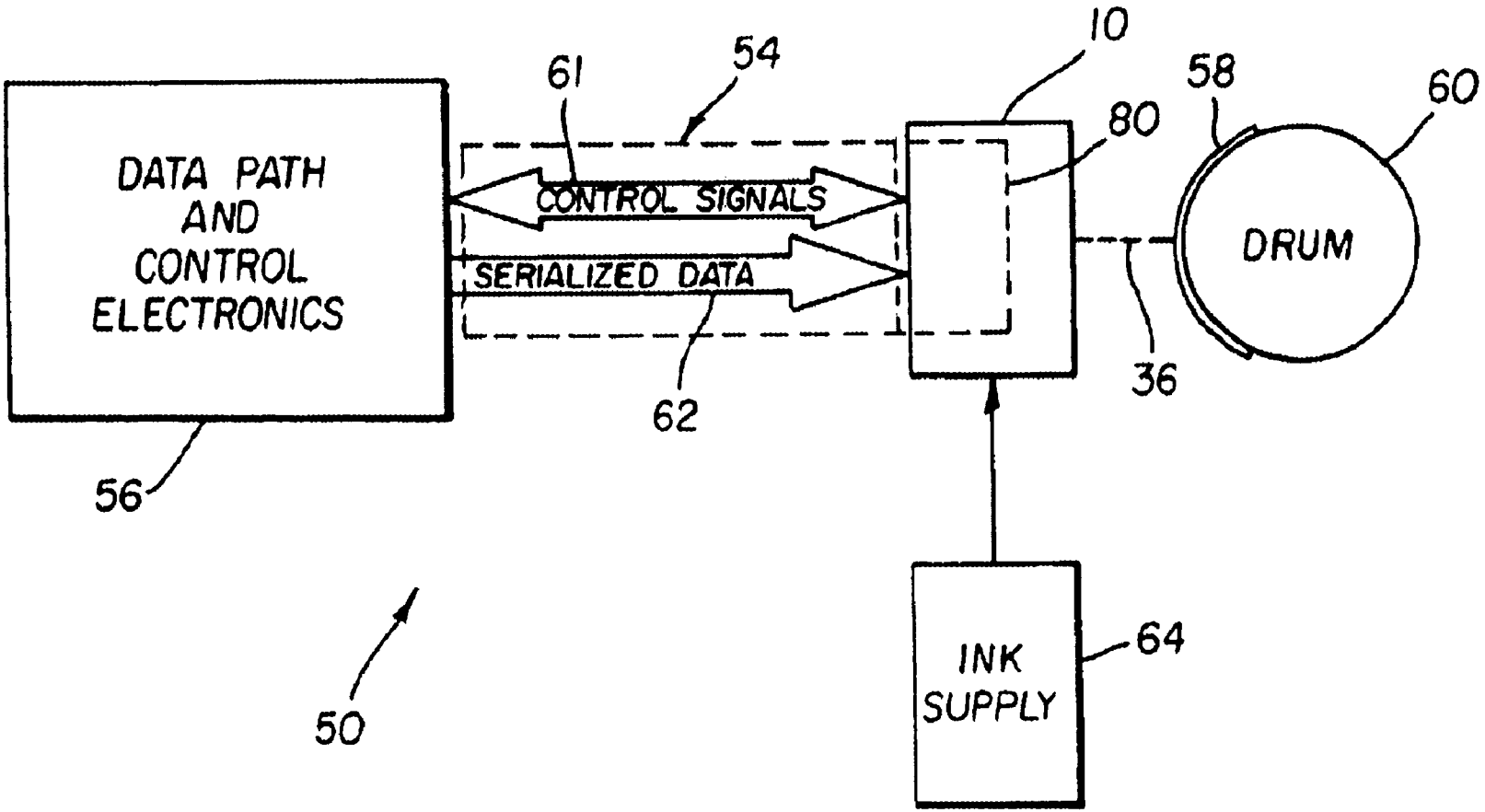
FIG. 3 is high-level block diagram of a thermal inkjet printhead assembly where data to the printhead is serialized.

FIG. 3 illustrates the use of data path and control electronics in a printer system 50 utilizing a thermal inkjet type printhead, such as printhead 10, where data serialization is applied. Printer system 50 includes a printhead 10 which utilizes two heater elements per nozzle (not shown in FIG. 3). The printhead 10 applies ink to media 58 mounted on a drum 60. In other configurations, the media may be mounted on a flatbed, and the printhead 10 positioned by way of a carriage to print onto the media 58. Ink is supplied to the printhead 10 from an ink supply system 64. The data path and control electronics 56 provides control signals 61 to the printhead 10 via interface 54.

As shown, interface 54 includes a serial DATA line 62 which carries serialized data to the printhead 10. The data is ported through a serial data shift register (discussed below) that restores the parallel nature of the data so that accurate printing is achieved. The data is routed so the assigned raster data is delivered to each of the heaters. Essentially, the data path and control electronics 56 ensures that while data for the next line of an image is being serially shifted down the serial shift register, current data for the line has been latched (saved) and is gated with an "enable" pulse to provide the correct amount of ink to be applied to the media being printed.

Physically, interface 54 includes a cable installed within the printer system 50 as part of the printhead assembly. The interface 54 also includes the various logic circuits, signal paths and discrete devices, and other similar components. Depending on the design resolution of the printhead 10, such components can consume considerable real estate on the printhead assembly. Therefore, the present invention provides a printhead assembly that minimizes the number of interconnections between the data path and control electronics 56 and the printhead 10.

Figure 4:
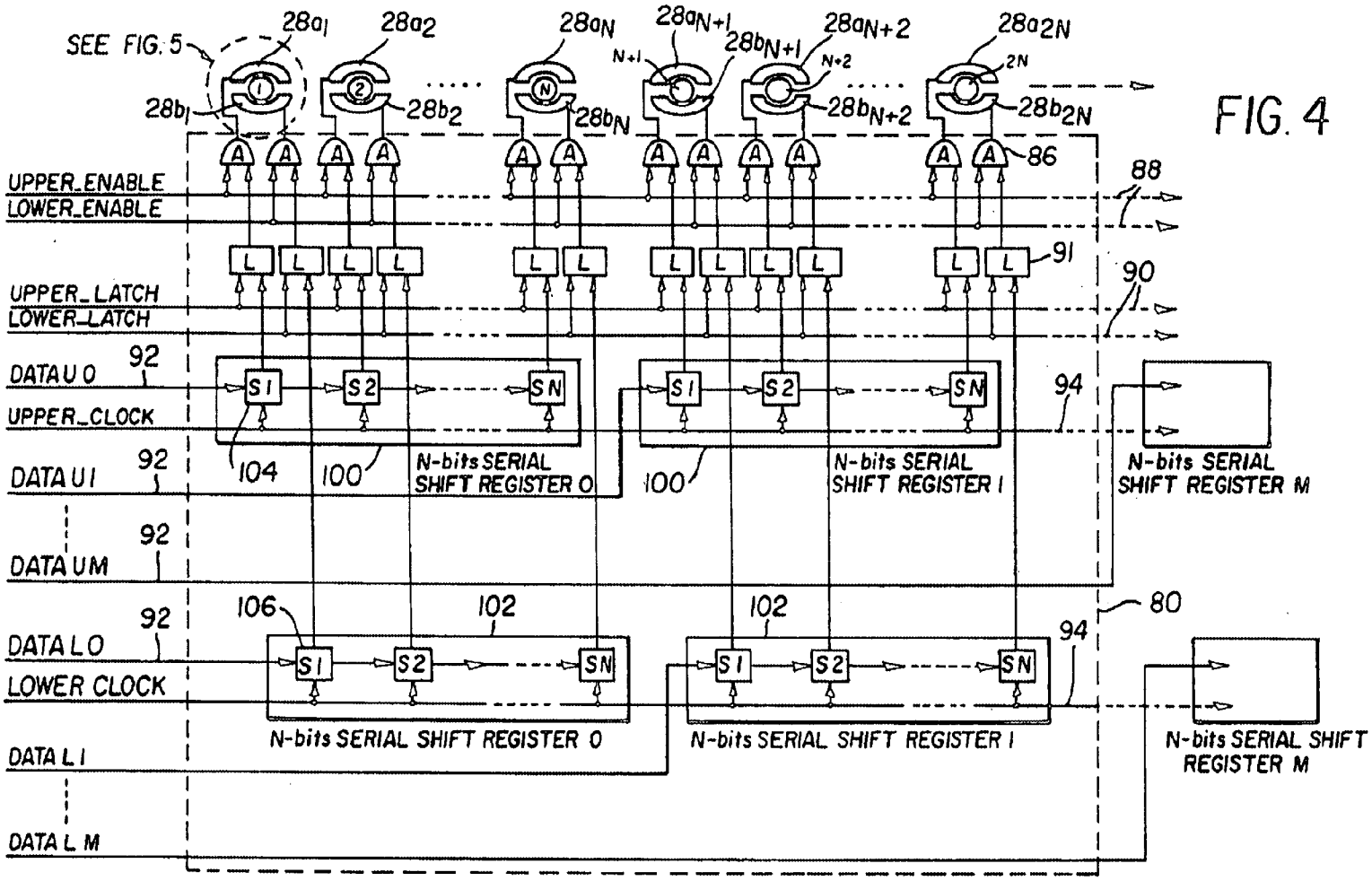
FIG. 4 is a detailed block diagram of the electrical interface within a printhead assembly using a serial shift register for driving nozzles in the printhead.

With reference now to FIG. 4, therein is shown a first embodiment of the invention, in the form of a block diagram of an interface 80 contained within the printhead 10. In essence, the interface 80 of the present invention uses serial shift registers to minimize the number of data lines required to drive the printhead 10. The interface 80 is configured to operate between the data path and control electronics 56 and the printhead 10 of the printhead assembly in which it is used. It should be understood that the interface 80 of FIG. 4 only shows a small number of circuits compared to what would be used in a more typical printhead supporting a larger number of printing nozzles.

As shown, each serial shift register 100 is composed of N shift register stages 104 connected in a serial fashion. Likewise, each serial shift register 102 is composed of N shift register stages 106 connected in a serial fashion. In the configuration shown, each serial shift register 100 of N shift register stages 104 supports data transfer to the upper nozzles, while each serial shift registers 102 with N shift register stages 106 supplies data for the lower heaters. Data is clocked through the shift registers 104, 106 upon the occurrence of a rising edge on the "CLOCK" line 94 with a separate clock line implemented for upper and lower heaters. When data has been loaded to all the elements in the serial shift register 100, 102, the Q outputs of the shift register stages 104, 106 are captured by use of latch registers 91 via LATCH lines 90. The latched data then serves to validate whether heat is applied to or not applied at a particular nozzle heater 28. The output 90*a* from the latch register 91 is gated using an AND logic element 86 with a pulse from an ENABLE line 88 and if a particular heater 28 is chosen for actuation, the latch output will be valid. The result of this AND operation is then used to switch on the nozzle heater driver 84 (FIG. 5), thus allowing the particular heater element to be biased with the heater power source.

In an actual printhead, the length of the N-bit serial shift registers 100, 102 is likely to be 32, 64, 128, 256, or 512 bits. The length of the N-bit serial shift register 100, 102 has a significant impact on the speed of access to an individual heater 28. As previously explained, all N bits in the shift registers 100, 102 must be loaded before the LATCH lines 90 can be actuated to transfer the contents of the shift registers into the latch registers 91. The period of time required to load an N-bit serial shift register limits how rapidly an individual heater can be addressed which, in turn, limits how rapidly a heater can be turned ON and then OFF. The minimum time required to address a heater is a function of the frequency of the clock signal on the CLOCK line 94 and the number, N, of shift register stages 104, 106 contained within the N-bit serial shift register 100 or 102. This relationship is governed by Equation 1 as follows:

$$\text{Minimum Heater Address Time}=(1/freq_{clock})*N \qquad \text{Equ. 1}$$

The upper limit in the choice of a clock frequency is often constrained by the speed of the shift register circuitry. To optimize the heater address time, the serial shift register, 100 or 102, should contain fewer shift register stages 104 or 106, to minimize the value of N. However, for a fixed number of nozzles in the printhead, if N is small there will be a larger number of serial shift registers 100 and 102. In a conventional printhead design, each additional serial shift register requires an additional DATA line 92 and a corresponding additional electrical interconnection to the printhead. A large number of N-bit serial shift registers 100 and 102 will require a large number of electrical interconnections to the printhead, which can be costly or physically incompatible with the desire to manufacture small printheads.

Thus, a design conflict exists between minimizing heater address time and minimizing the number of interconnects to the printhead. To minimize the number of DATA lines 92 to the printhead, the number of shift register stages, N, in the N-bit serial shift registers 100, 102 would be maximized. However, a large value of N significantly increases the time to address an individual heater and may not be compatible with the fluids in use as well as the printing rates desired. Therefore, the present invention provides additional embodiments and methods of reducing the number of interconnects in the printhead assembly that take into account the heater address time.

Figure 5:
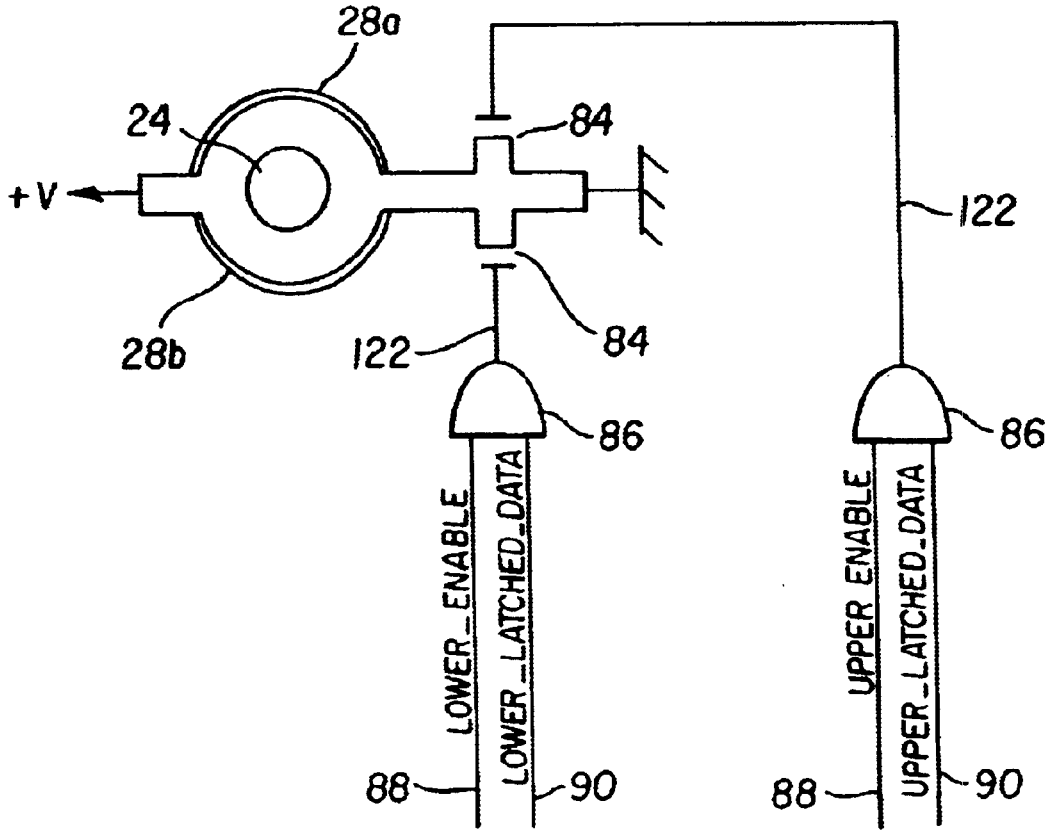
FIG. 5 is a circuit diagram of the interconnection between the nozzle heaters and the nozzle drivers.

With reference to FIG. 5, therein is shown the details of the nozzle heaters 28, which will guide in understanding the additional embodiment of the invention. Heaters 28*a*, 28*b* are located at the opposing sides of a printhead nozzle 24. An ENABLE line 88 and LATCHED_DATA line 90*a* are ANDED together at AND gate 86. The output 122 of the AND gate 86 provides a signal to a heater driver 84 which applies power to either upper heater 28*a* or lower heater 28*b*, as appropriate. In this example, either one of the two heaters 28*a* or 28*b* associated with a nozzle 24, is capable of actuating the nozzle. Applying power to either the upper heater 28*a* or the lower heater 28*b* will cause the ink droplet stream to deflect away from the energized heater.

Figure 6:
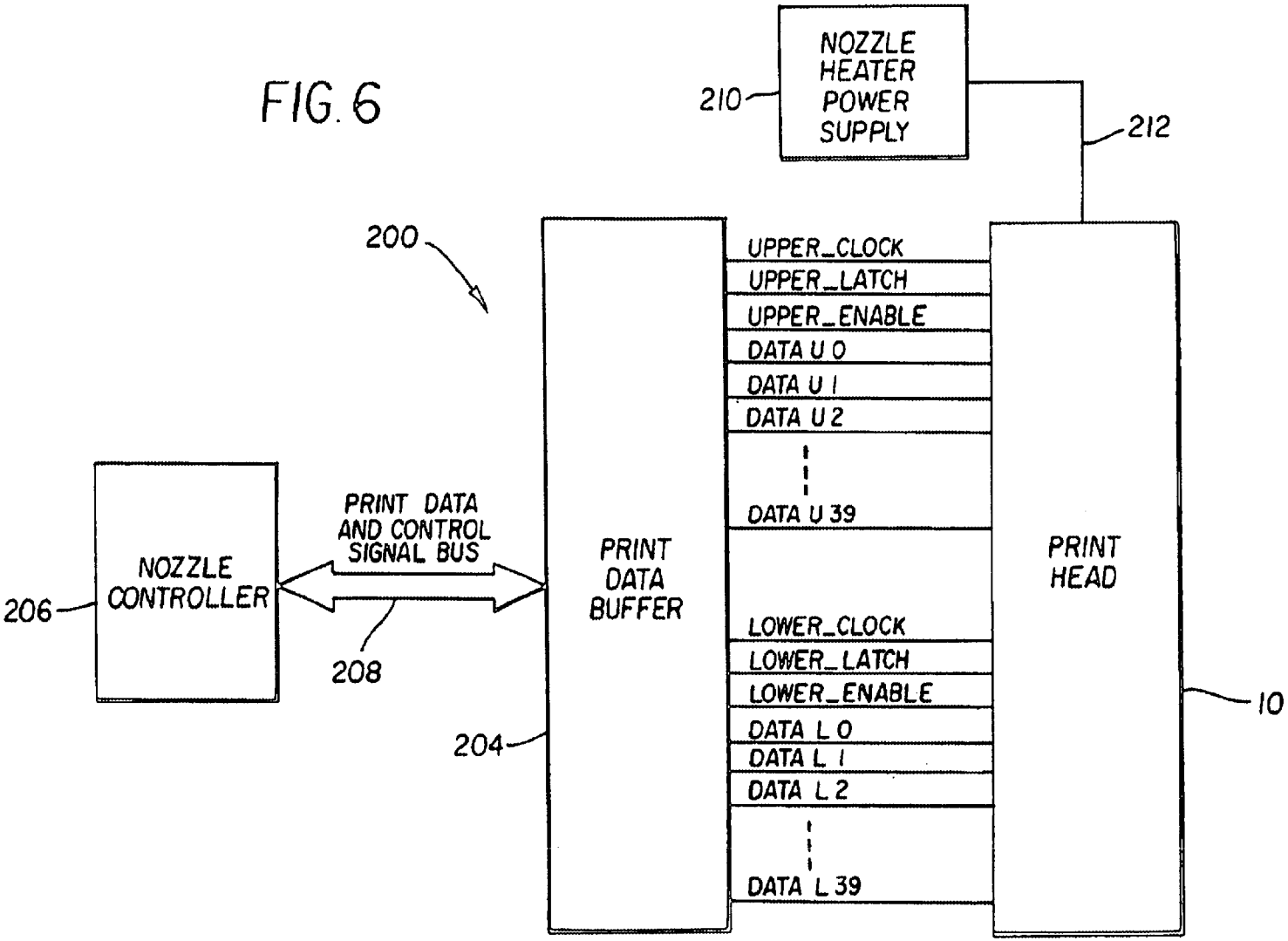
FIG. 6 is a block diagram of the interconnection of the printing system to the printhead.

With reference now to FIG. 6, therein is shown a printhead assembly, denoted generally as 200, with interconnections between the print data buffer 204 and the printhead 10. The nozzle controller 206 processes the image path data to be compatible with the printhead 10 and provides the control signals necessary to operate the printhead 10. The nozzle controller 206 also transfers the data and control signals via the print-data-and-control-signal bus 208 to the print data buffer 204 which provides a buffer function for all of the signals to the printhead 10. The nozzle heater power supply 210 provides power to the printhead via power line 212.

FIGS. 7, 8, 9, 10 and 11 are general block diagrams of respective different data shift register structure for a large printhead, such as printhead 10, incorporating a significant number of heaters. For simplicity, the data output lines to the respective latching registers from each shift register stage, the CLOCK 94, LATCH 90, and ENABLE lines 88 have been omitted in each Figure. For the example of FIG. 7, there are 40 upper 32-bit serial shift registers 100 and 40 lower 32-bit serial shift registers 102. Each 32-bit serial shift register 100 and 102 has a corresponding data input, DATAU0-DATAU39 and DATAL0-DETAL39, respectively. Thus, there are 80 DATA lines 92 to the printhead.

Figure 7:
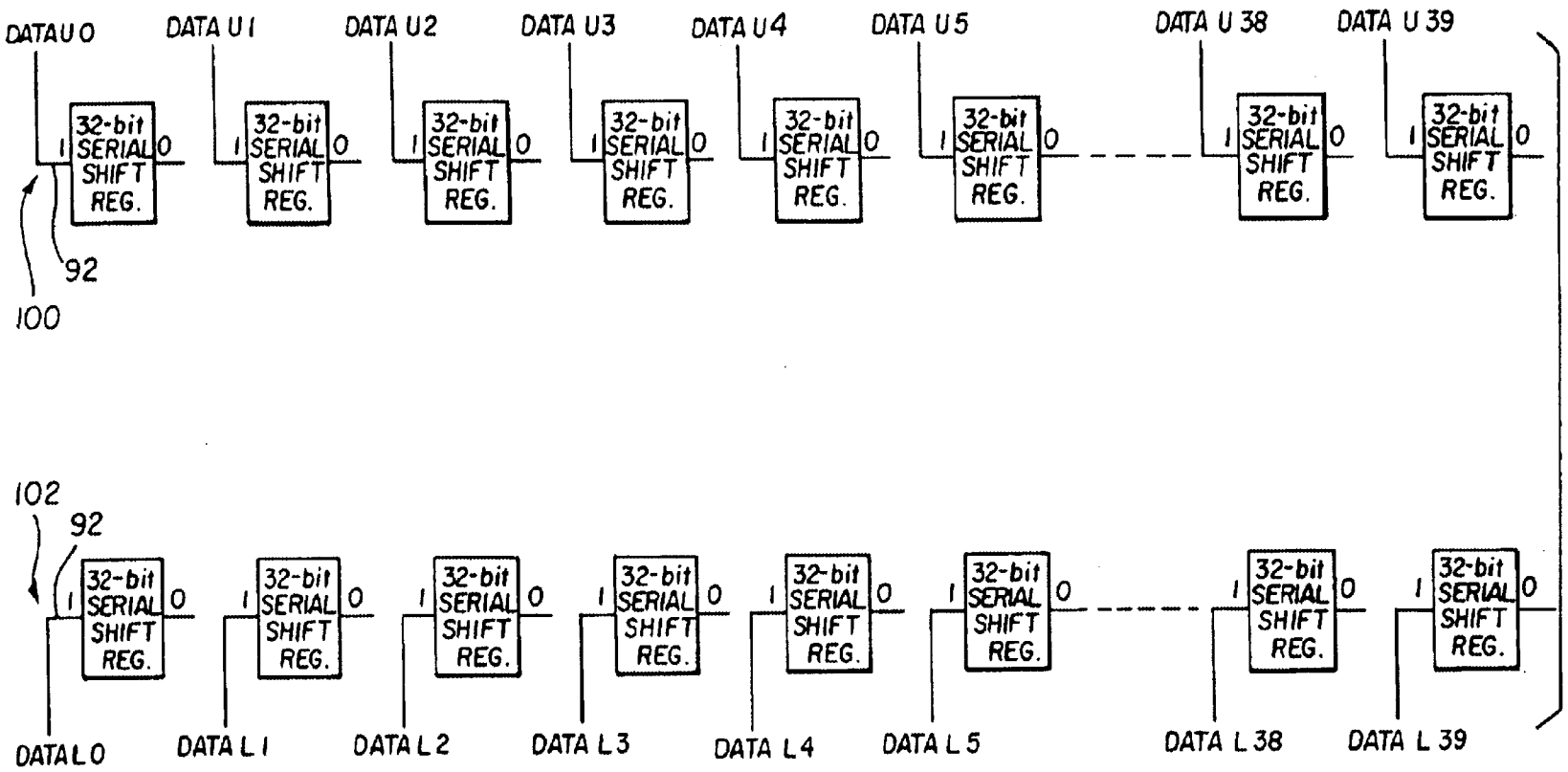
FIG. 7 is a block diagram of a serial shift register configuration in a thermally steered inkjet printhead.
Figure 8:
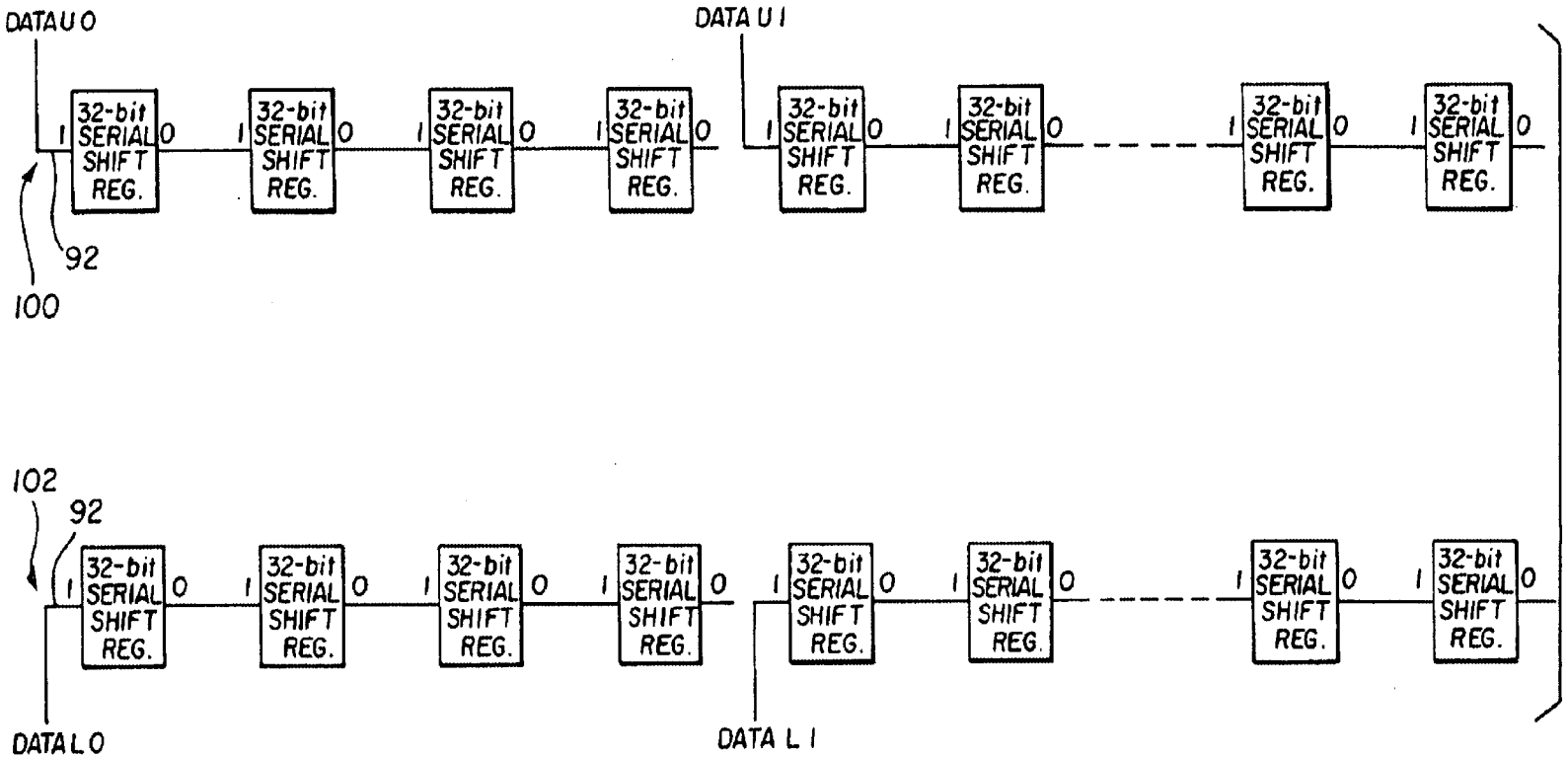
FIG. 8 is a block diagram of the data serial shift register configuration of a printhead.

FIG. 8 is a block diagram of an interconnection scheme for a large printhead with a significant number of heaters. As in FIG. 7, 80 of the 32-bit serial shift registers are shown, however, the data structure has been reconfigured to decrease the number of DATA lines 92 by a factor of 4. Specifically, FIG. 8 shows 4 of the 32-bit shift registers serially connected to form a larger 128-bit serial shift register. Only 20 DATA lines 92 are required for this configuration, compared to 80 DATA lines 92 for FIG. 7. To maintain the same heater address time as in FIG. 7, the frequency of the clock would need to be increased by a factor of 4 since the number of shift register stages in the larger serial shift register has increased from N=32 to N=128. However, there may be physical barriers which prevent the implementation of this architecture. Nevertheless, it is well known that large printheads are often constructed of small devices 108 which are used as modular building blocks for large printheads.

Figure 9:
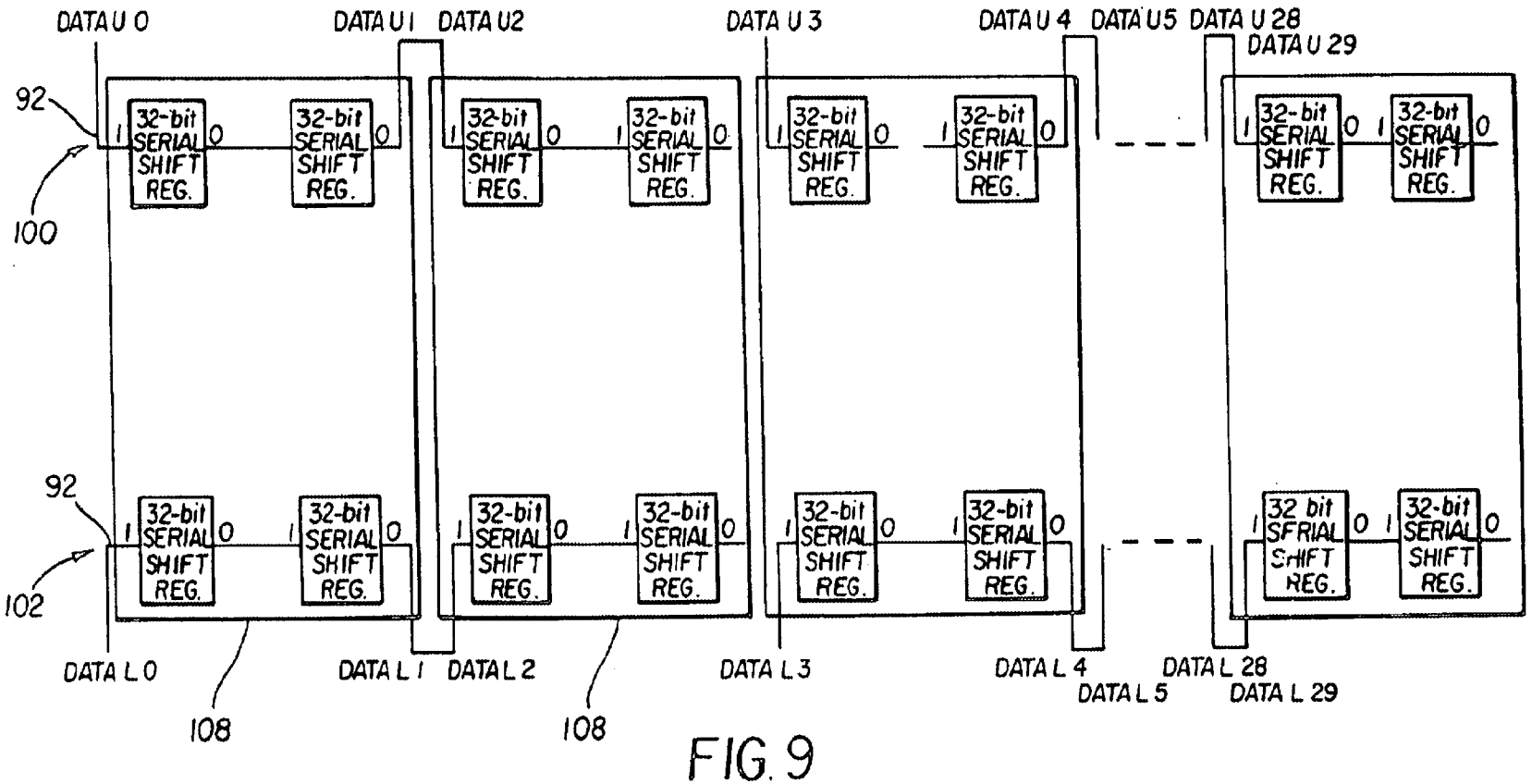
FIG. 9 is a block diagram of the data serial shift registers in a printhead configured with small devices.

FIG. 9 is a block diagram of an interconnection scheme for a large printhead constructed with small devices 108. In this example, each small device 108 contains two 32-bit serial shift registers for the upper serial shift register 100 and two 32-bit serial shift registers for the lower serial shift register 102. Each small device 108 also contains 64 nozzles 24 and the associated 64 upper heaters 28*a* and 64 lower heaters 28*b*. The small devices 108 provide an opportunity to build printheads in a modular fashion, providing flexibility in the size of the printhead.

As shown, the inputs (I) and outputs (O) of the serial shift register stages 100 and 102 allow the user to configure the printhead in a manner similar to FIG. 8. However, because the interconnection of the serial shift registers of different small devices 108 would require additional connections to the printhead, the additional connections to the printhead would reduce the advantage of using long shift registers. The example printhead of FIG. 9 would require 60 DATA lines 92. Some of these DATA lines 92 are jumpers from one small device 108 to the next small device 108, which accounts for two DATA lines 92. For small devices 108 containing more than two 32-bit registers for the upper serial shift register 100 and more than two 32-bit shift registers for the lower serial shift register 102, the interconnection scheme shown in FIG. 9 would produce a proportionately greater reduction in interconnections to the printhead as to the connection scheme of FIG. 7.

Figure 10:
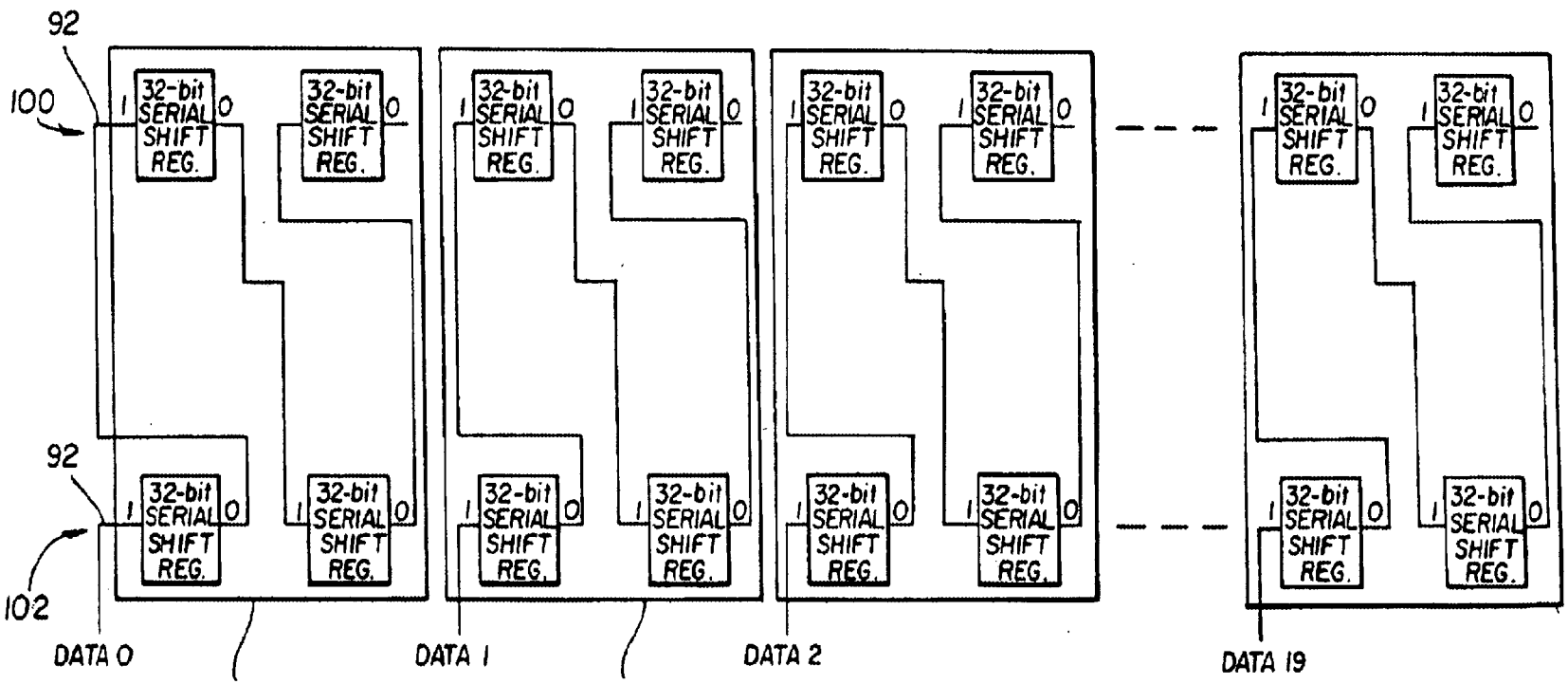
FIG. 10 is a block diagram of the data serial shift registers in a printhead configured with small devices which uses the second embodiment of the invention.

FIG. 10 is a block diagram of an interconnection scheme for a large printhead constructed with modular small devices 108. Because of the use of the small device 108, the printhead could be built in a modular fashion. In the embodiment of FIG. 10, the 32-bit shift registers in the lower serial shift register 102 are connected in serial fashion with the 32-bit shift registers in the upper serial shift register 100. By serially connecting the 4 shift registers within the small device 108, the length of the shift register is again 128-bits as it was in FIG. 9, however, this embodiment provides a significant reduction in interconnections to the printhead. For this example, 20 DATA lines 92 would be required to interconnect to the printhead. The seemingly simple approach shown in FIG. 10 is not obvious because the shift registers constructed in this manner contain different types of data, some for upper heaters and some for lower heaters. In addition, the information in the serial data for upper heater associated with nozzle 1 is separated by 32-bits from the data associated with the lower heater associated with nozzle 1. The creation of this serial bit stream requires that the data associated with a given nozzle (upper heater and lower heater) be separated by the number of bits in the small serial shift registers (32-bits in this example). This can be accomplished by buffering and/or providing controlled delays or selection counters.

The embodiment shown in FIG. 10 shows that the upper and lower serial shift registers are serially connected to form a single serial shift register which is used to address the upper and lower heaters 28*a* and 28*b*, respectively. Since there is only one serial shift register in the configuration of FIG. 10 (as opposed to two serial shift registers as shown in FIG. 4, FIG. 6 and FIG. 7), the number of clock lines and latch lines can also be reduced. In FIGS. 4, 6, and 7, two clock lines are required, UPPER_CLOCK 94 and LOWER_CLOCK 94. In the embodiment of FIG. 10, there is a single serial shift register common to both the upper and lower heaters 28*a*, 28*b*, such that the serial shift register can be driven with a single CLOCK line 94. Thus, the present inventions provides an interconnection mechanism that eliminated the requirement of separate LATCH lines for each serial shift register used in the printhead assembly so that a single serial shift register common to upper and lower heaters can be driven with a single LATCH line 90. In this way, the embodiment of FIG. 10 saves an additional two interconnections to the printhead by eliminating separate clock and latch connections.

Figure 11:
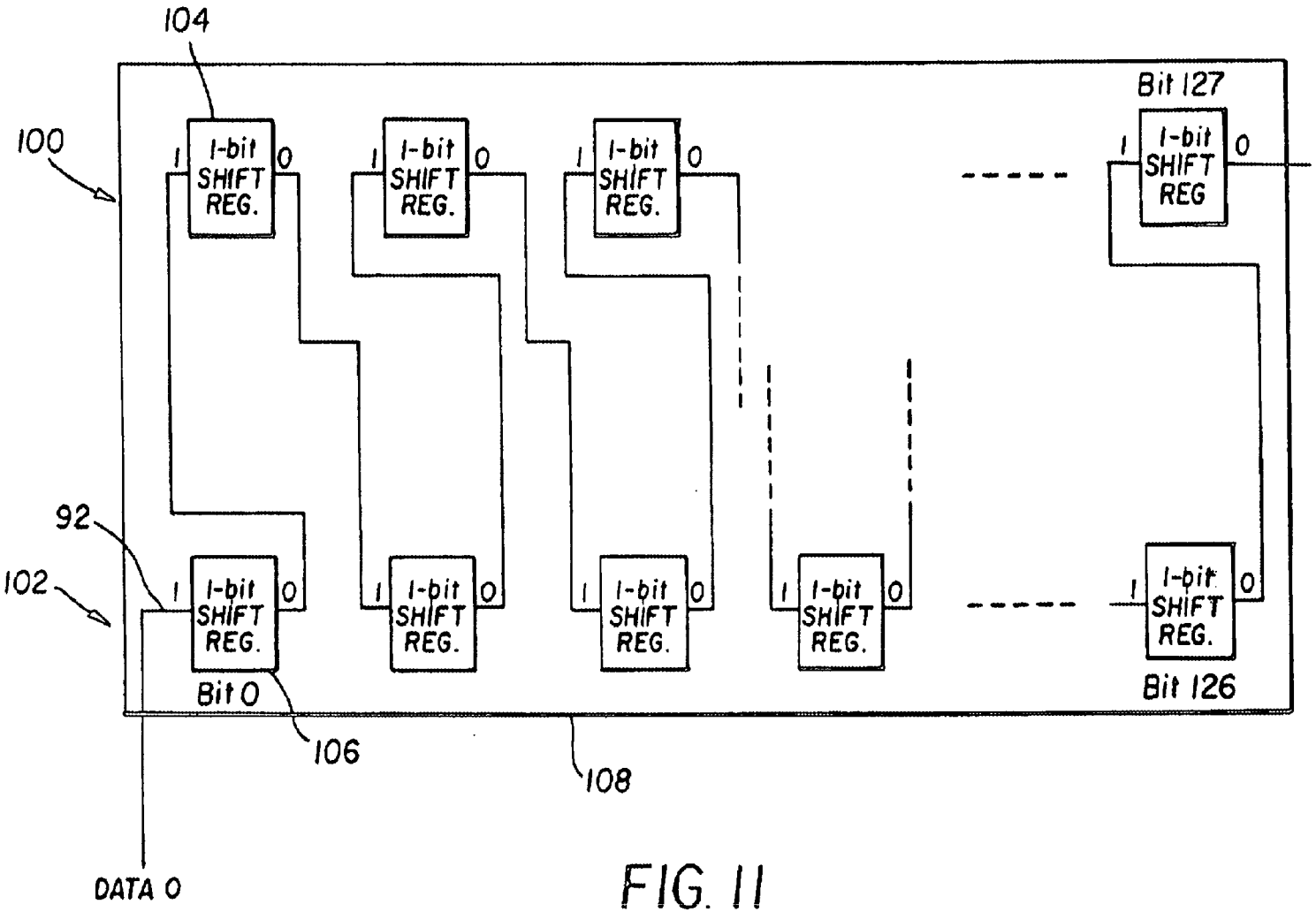
FIG. 11 is a block diagram of the data serial shift registers in a printhead configured with small devices which uses the third embodiment of the invention.

With reference now to FIG. 11, there is shown a third embodiment interconnection scheme that minimizes interconnections in the printhead assembly according to the invention. Specifically, as shown in FIG. 10, there is required a 32 bit separation of the two data bits (associated with the two heaters 28*a*, 28*b* at a given nozzle 24) in the serial data stream. In contrast, FIG. 11 shows an interconnection of the upper serial shift register 100 and the lower serial shift register 102 where adjacent shift register stages 104, 106 in the combined shift register represent two heaters 28*a*, 28*b* associated with one nozzle 24. The output of a lower shift register stage 106 is connected to input of the upper shift register stage 104 while the output of the upper shift register stage 104 is connected to the input of the lower shift register stage 106, resulting in an alternating interconnection scheme. This alternating interconnection of the upper shift register stages 104 and lower shift register stage 106 allows the data bits associated with the two heaters 28*a*, 28*b* (associated with a particular nozzle 24) to be adjacent to each other in the data stream, rather than being separated by 32 bits, as was the case in FIG. 10.

The creation of adjacent data bits in the data stream associated with the two heaters 28*a*, 28*b* for a given nozzle is much easier and simplifies the circuitry utilized to create the data stream. In this example all 4 of the 32-bit serial shift registers would be interleaved in the fashion described above, so the complete length of the shift register would be 128 bits. The 128-bit shift register would have one DATA line 92 input from outside the small device 108. FIG. 11 shows that the interconnection scheme can be used to connect the shift register stages 104, 106 within one small device 108 in a modular printhead. Thus, the embodiment of FIG. 11 also minimizes the number of DATA lines 92 to a total of 20 for the printhead heater configuration originally described in FIG. 9.

The embodiment shown in FIG. 11 shows the upper and lower shift registers as serially connected to form a single serial shift register which is used to address the upper and lower heaters 28*a* and 28*b*, respectively, with respective outputs from respective shift register stages. Since there is only one serial shift register in the interconnection scheme of FIG. 11 (compared to two serial shift registers in the interconnection schemes of FIGS. 4, 6 and 7), the total number of CLOCK lines and LATCH lines is reduced. In FIGS. 4, 6, FIG. 7, two clock lines are required, UPPER_CLOCK 94 and LOWER_CLOCK 94. In the embodiment of FIG. 11, there is a single serial shift register common to the upper 28*a* and lower heaters 28*b* which can be driven with a single CLOCK line. In this way, the embodiment of FIG. 11 further reduces the number of interconnections of the printhead assembly and eliminates unnecessary clock and latch connections.

Table 1 shows the number of interconnects required for the various interconnections schemes of the invention (the interconnects required for the ENABLE signals 88 are not included in the table).

TABLE 1

Total number of interconnects for each embodiment of the invention.

| INTERCONNECT OBJECTIVE | FIG. | DATA | CLOCK | LATCH | TOTAL INTERCONNECTS |
|---|---|---|---|---|---|
| Maximum Address Speed | 7 | 80 | 2 | 2 | 84 |
| Continuous Head Reduction | 8 | 20 | 2 | 2 | 24 |
| Modular Head Reduction | 9 | 60 | 2 | 2 | 64 |
| Modular Head Embodiment 2 | 10 | 20 | 1 | 1 | 22 |
| Modular Head Embodiment 3 | 11 | 20 | 1 | 1 | 22 |

Figure 12:
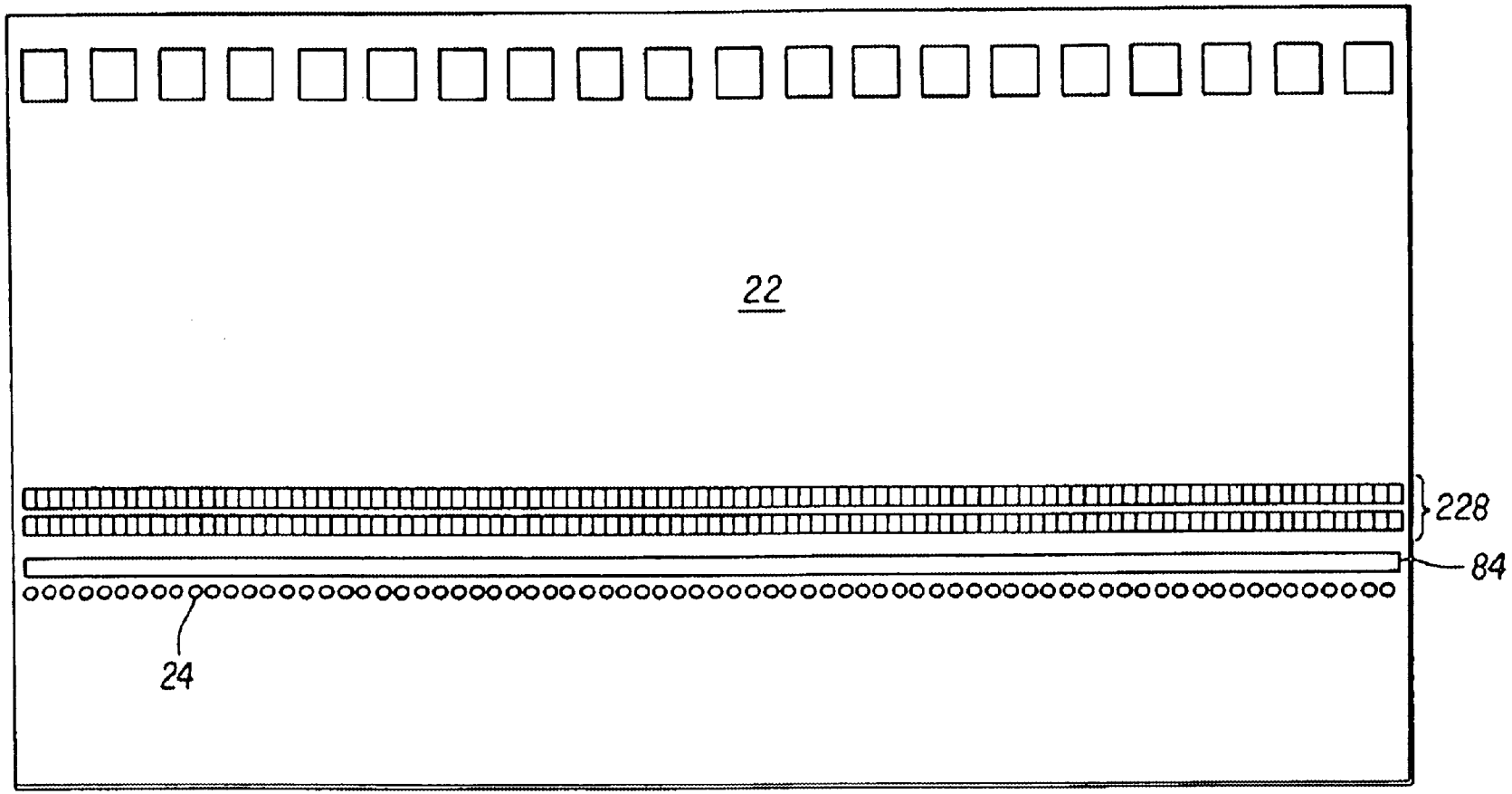
FIG. 12 is a top plan view schematic of printhead 10.

With reference now to FIG. 12, therein is shown a top-down view of the inkjet printhead 10 arranged so that nozzles 24 and shift register stages 228 facilitate cleaning of the printhead 10 according to the invention. The printhead 10 comprises a plurality of nozzles 24 arranged in a straight line across the printing length of the printhead 10. This forms an array for ejecting ink to form an image on a receiver member crossing nozzles 10.

Figure 13:
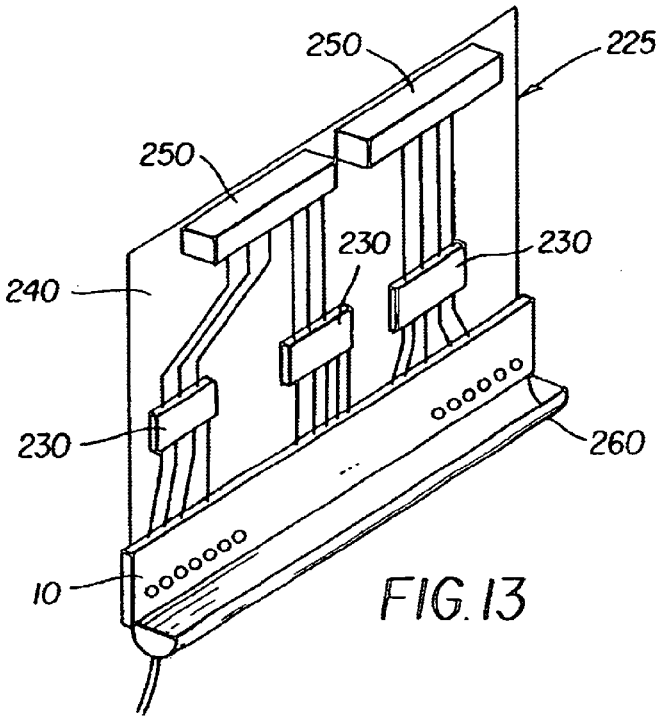
FIG. 13 shows a printhead assembly in perspective with the components arranged such that optimum cleaning and maintenance of the printhead is promoted.
Figure 13A:
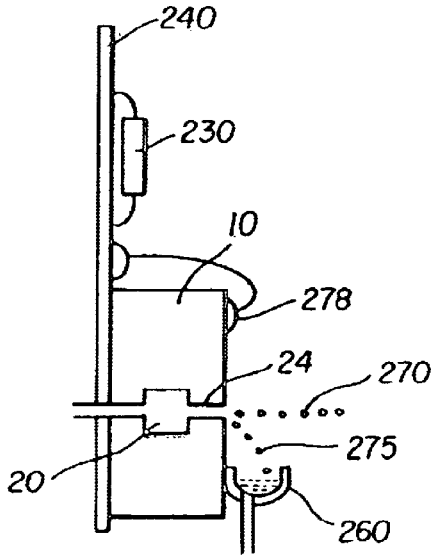
FIG. 13A is a side view in schematic that illustrates the flow of ink droplets with respect to the printhead assembly shown in FIG. 13.

A plurality of actuators in the form heat drivers 84, are provided such that each actuator 84 is associated with each respective nozzle 24. For simplicity, the terms "actuator" and "heat drivers" shall be referred to interchangeably. Preferably, each actuator 84 is separately drivable to affect ejection of ink from the respective nozzle 24. The plurality of data shift registers stages, denoted here as 228, are then arranged such that each stage 228 is associated with a respective nozzle actuator 84 and nozzle actuators 84, in turn, are associated with each nozzle heater element (either upper 28*a* or lower heater element 28*b*) and with different shift register stages 228. The shift register stages 228 are adapted to shift data from one stage to a next stage to distribute data to the different stages 228. Cleaning of the printhead 10 is provided by the positioning of the shift register stages 228 and their electrical interconnections using wire-bonding to bond pads 278 which are positioned on the same side of the printhead 10 substrate 22 such that enough room is provided for a cleaning mechanism (not shown) to reach the nozzles 24 and not cause damage to the shift register circuits on the printhead. FIG. 13A illustrates the position of the bond pads and wirebonds (278). The fact that shift register stages 228 are arranged on the same side as opposed to other areas of the printhead 10, means that a space is provided for cleaning of the printhead 10 using well known cleaning techniques such as, for example, by using a brush, wiper, sprayer, vacuum suction device, and/or spitting of ink through the plurality of nozzles 24. FIG. 13 shows an implementation of a printhead assembly 225 utilizing this shift register arrangement to promote printhead cleaning.

The assembly 225 shown in FIG. 13 shows that with this shift register arrangement, the external electrical parts are located up and away from the area of exposure to the ink droplet streams 270 and 275 shown in FIG. 13A. These components include electrical circuits 230 that are part of electrical interface 54 that are external to the printhead. The circuit board 240 upon which the printhead 10, and external electrical circuits 230 are located is also the site for cable connections 250 to bring in external data and control signals to the printhead assembly 225. For applications using continuous inkjet actuators, this arrangement of electronics lends itself to the implementation of a gutter 260 to collect ink droplet streams during periods when there is no data to be written to media. Inkjet droplet stream 270 is directed to deposit on recording media for recording an image, while stream 275 is directed to be recycled using gutter 260 to collect the ink droplets.

Figure 14A:
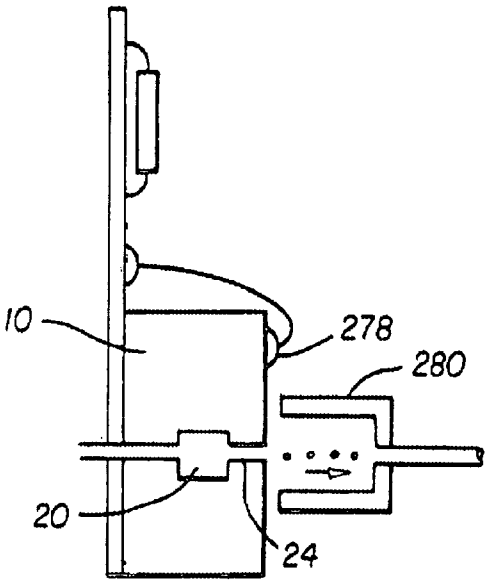
FIG. 14A is a side view in schematic that illustrates the printhead with an arrangement of electronics and printhead components to promote optimum cleaning when parked at the cleaning station.
Figure 14:
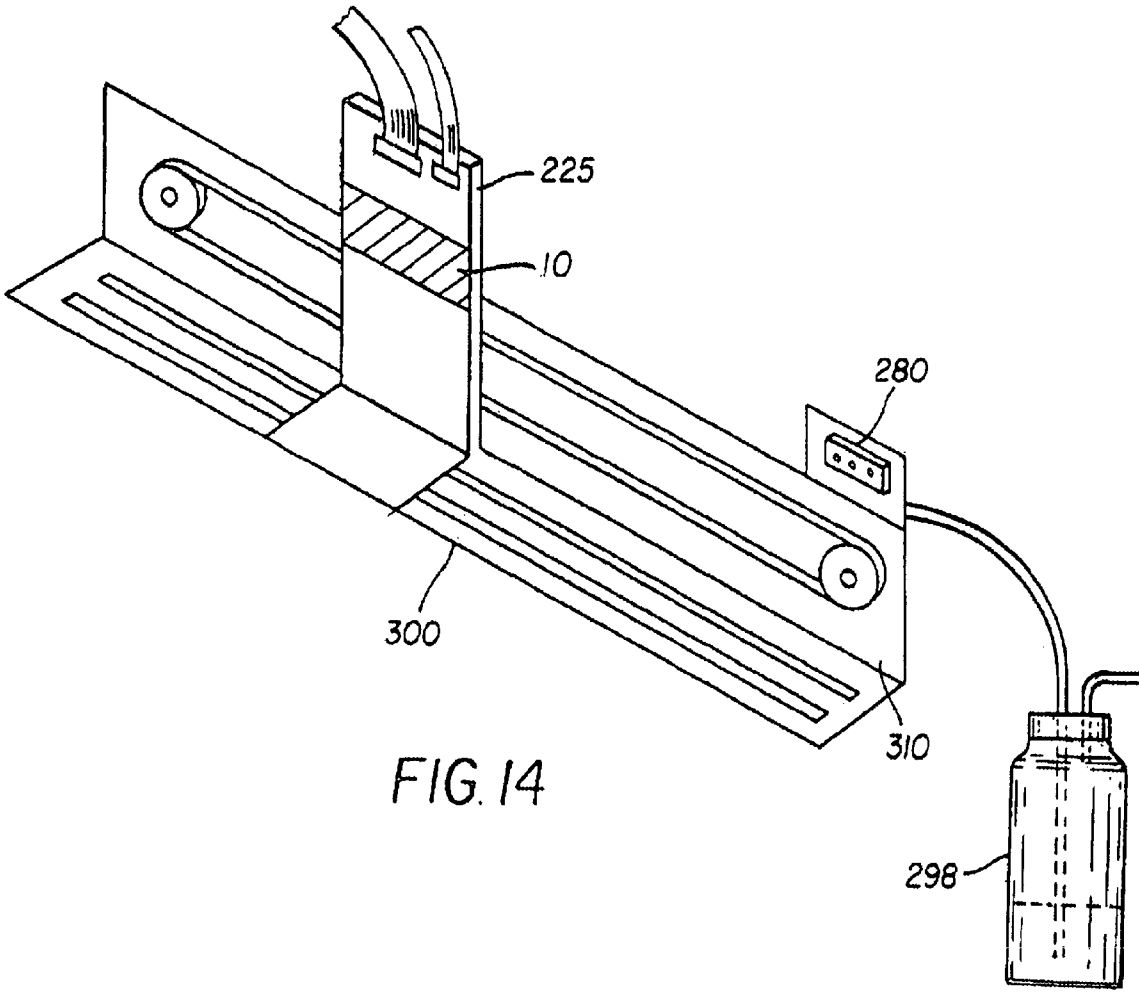
FIG. 14 is a schematic illustration in perspective of the printhead assembly of FIG. 12 installed on a printer carriage with a printhead cleaning station implemented as part of the printer.

FIG. 14 illustrates a typical printer arrangement 300 utilizing a carriage assembly 310. The printhead assembly 225 is mounted upon the carriage assembly 310 which includes, for example, rails upon which the printhead assembly 225 is mounted for movement. Alternatively, the cleaning assembly may be moved to position itself in position for cleaning of the printhead. When it is desired to clean the printhead 10, the printer's control system will position the printhead assembly 225 to face the cleaning station 280 to proceed with the cleaning of the print head. In this implementation, a vacuum cleaning system is shown. FIG. 14A shows the printhead parked at the cleaning station 280, such that a rubber or other material shroud provides a vacuum tight enclosure about printhead 10. Using the force of the vacuum, inkjet droplets that are located in the nozzle or on the outside surface of the nozzle are drawn into a collection vessel 298. The vacuum is provided by vacuum pump 295. Other forms of cleaning devices including blades, brushes, etc. may also be used. With the use of blades, it usually is desirable to provide the surface of the printhead with a planar surface. In the embodiment of FIG. 1, a passivation layer may be provided over substrate 22 to cover the heater elements 28*a*, 28*b*and provide a planar surface to the printhead with openings for the nozzle openings. Preferably, the placement of the bond pads 278 on the printhead that are electrically connected to the shift registers near the nozzle will be at least 2 to 3 mm spacing from the nozzle openings to provide clearance for movement of the printhead assembly relative to the cleaning station and for positioning of the printhead assembly at the cleaning station.

While this invention has been described with reference to illustrative embodiments, this description is not intended to be construed in a limiting sense. For example, the principles of the invention can be applied to other types of recording elements, such as LEDs, thermal recording elements, lasers, and other recording element configurations. As such, various modifications and combinations of the illustrative embodiments, as well as other embodiments of the invention, will be apparent to persons skilled in the art upon reference to the description. It is, therefore, intended that the appended claims encompass any such modifications or embodiments.

PARTS LIST

10 . . . inkjet printhead
12 . . . mounting block
14 . . . manifold
16 . . . inlet/outlet tubes
18 . . . fluid flow channels
20 . . . ink reservoir
22 . . . substrate
24 . . . nozzle or nozzles
26 . . . nozzle opening
28 . . . heater or heaters
28*a* . . . upper heater
28*b* . . . lower heater
32 . . . nozzle cavity
34 . . . ink
36 . . . ink stream
50 . . . printer system
54 . . . interface
56 . . . data path and control electronics
58 . . . media
60 . . . drum
61 . . . CONTROL line
62 . . . DATA line
64 . . . ink supply
80 . . . interface
84 . . . heater drivers
86 . . . AND gate logic element
88 . . . ENABLE line
90 . . . LATCH line
90*a* . . . Latched Data
92 . . . DATA line
94 . . . CLOCK line
100 . . . serial shift register
102 . . . serial shift register
104 . . . shift register stage
106 . . . shift register stage
108 . . . small device
122 . . . output
200 . . . print head assembly
204 . . . print data buffer
206 . . . nozzle controller
208 . . . print-data-and-control-signal bus
210 . . . nozzle heater power supply
212 . . . power line
228 . . . shift register stages
225 . . . print head assembly

230 . . . external electrical circuits
240 . . . print head circuit board
250 data and control signal connectors
260 gutter
270 ink droplet stream to media
275 ink droplet stream to gutter
278 bond pads and wire bonds
280 printhead cleaning station
295 vacuum pump
298 ink collection bottle
300 printer system using carriage
310 printer carriage

What is claimed is:

1. A method of providing image data in a printer apparatus, the method comprising:

providing a plurality of recording elements arranged in an array on a printhead for recording of an image on a receiver medium;

providing a plurality of actuators associated with each respective recording element each actuator being separately drivable to affect recording by a respective recording element;

providing a cleaning assembly for cleaning the recording elements;

providing a plurality of shift register stages, each stage being associated with a respective different actuator, each recording element being associated with plural different shift register stages and shifting data from one stage to a next stage to distribute data to the different stages, the shift register stages being located all to one side of the array of recording elements;

altering the position of the cleaning assembly relative to the array of recording elements wherein the shift register stages are sufficiently positioned away from the recording elements to facilitate cleaning of the recording elements by the cleaning assembly without damaging the shift register stages; and providing bond Pads on an external surface of the printhead so that the bond pads are sufficiently positioned laterally to said one side and away from the recording elements to facilitate cleaning of the recording elements without interference with electrical connecting elements attached to the bond pads; and wherein a first plural number of shift register stages of said plurality of shift register stages is associated with a first plural number of actuators of a first plural number of the recording elements and the first plural number of shift register stages are connected as a first shift register for shifting data from one stage associated with one recording element of the first plural number of recording elements directly to another shift register stage associated with another recording element of the first plural number of recording elements to distribute data to the different stages so that, for most of the stages forming the first shift register, data shifted into a stage associated with an actuator for one recording element is shifted directly into a stage associated with another actuator for a different recording element in the course of shifting data from stage to stage; and wherein a second plural number of shift register stages of said plurality of shift register stages is associated with a second plural number of actuators of a second plural number of the recording elements, the second plural number of shift register stages being connected as a second shift register of plural shift register stages for shifting data from one stage associated with one recording element of the second plural number of recording elements directly to another shift register stage associated with another recording element of the second plural number of recording elements to distribute data to the different stages so that for most stages of the second shift register data shifted into a stage associated with an actuator for one recording element of the second plural number of recording elements is shifted directly into a stage associated with another actuator for a different recording element of the second plural number of recording elements in the course of shifting data from stage to stage; and wherein at least some of the recording elements in the second plural number of recording elements are the same recording elements in the first plural number of recording elements and wherein the first plural number of shift register stages are all different shift register stages from the second plural number of shift register stages and the first plural number of actuators are all different actuators from the second plural number of actuators.

2. The method of claim 1 wherein said recording elements comprise nozzles and said plurality of actuators comprise heater elements.

3. The method of claim 2 wherein said heater elements when heated are capable of thermally steering ink out of said nozzles.

4. The method of claim 3 wherein said heater elements are configured as upper and lower heaters about each of said nozzles.

5. The method of claim 2 wherein said first and second shift registers are positioned on the same side of the array of nozzles so that a space is provided for cleaning said nozzles.

6. The method of claim 1 wherein said plurality of shift register stages are organized into 128 bit length shift registers.

7. The method of claim 1 and wherein each recording element is a nozzle on an ink jet printhead.

8. The method of claim 7 and wherein the actuators are each a heater element.

9. The method of claim 1 and wherein data output from one shift register stage of the second plural number of shift register stages is input to a shift register stage of the first plural number of shift register stages.

10. A printer comprising:

a printhead assembly including a printhead with a plurality of recording elements, each of said recording elements having associated therewith plural actuators for separately determining an output of the recording element;

a cleaning assembly for cleaning the printhead;

data path and control electronics circuitry operably coupled with said printhead assembly for providing image data to said printhead assembly for individually actuating the plural actuators;

shift register means for delivering said image data to said printhead assembly, said shift register means located all to one side of the printhead assembly to facilitate cleaning of the plurality of the recording elements;

a series of electrical contacts that are supported on an external surface of the printhead with connecting elements attached thereto and the electrical contacts are sufficiently positioned laterally to said one side of to recording elements to facilitate cleaning of the plurality of recording elements without interference with the connecting elements attached to the electrical contacts; and wherein each of the recording elements has similar plural actuators so that different counterpart actuators are provided for each recording element, and further wherein said shift resister means includes a plurality of shift register stages, each stage being associated with a respective actuator each recording element being associated with plural different shift register stages, the shift register stages being adapted to shift data from one stage to a next stage to distribute data to the different stages so that for at least most shift register stages data shifted into a shift register stage associated with one counterpart actuator for one recording element may be shifted directly into a shift resister stage associated with a second counterpart actuator associated with a different recording element than the one recording element in the course of shifting data from shift resister stage to shift register stage.

11. The printer of claim 10 wherein said plural actuators comprise heaters.

12. The printer of claim 10 wherein the recording elements comprise nozzles and the plural actuators comprises least two heater elements that are associated with each nozzle and are separately actuatable.

13. The printer according to claim 11 and wherein the recording element is an inkjet nozzle, and plural actuators are heater elements associated with each nozzle.

14. The printer of claim 13 wherein there are two of said heater elements associated wit each nozzle, an upper heater element and a lower Beater element, and said shift register means includes a plurality of shift registers and each shift register includes plural shift register stages wherein some shift register stages are ranged to store data to control upper heater elements and other shift register stages are arranged to store data to control lower heater elements.

15. The printer according to claim 11 and wherein the recording element is an inkjet nozzle, and the plural actuators are heater elements associated with each nozzle and wherein the one counterpart actuator for the one recording element comprises an upper heater element and a second different counterpart actuator for the one recording element comprises a lower heater element.

16. A method of providing image data in a printer apparatus, the method comprising:

providing a plurality of recording elements arranged in an array on a printhead for recording of an image on a receiver medium;

providing a plurality of actuators associated with each respective recording element each actuator being separately drivable to affect recording by a respective recording element;

providing a cleaning assembly for cleaning the recording elements;

providing a plurality of shift register stages, each stage being associated with a respective different actuator, each recording element being associated with plural different shift register stages and shifting data from one stage to a next stage to distribute data to the different stages, the shift register stages being located all to one side of the array of recording elements and wherein data to the different states is distributed so that for at least most shift register stages the data shifted into a shift register stage associated with an actuator for one recording element is shifted directly into a stare associated with another actuator for a different recording element in the course of shifting data from stage to stage;

altering the position of the cleaning assembly relative to the array of recording elements wherein the shift register stages are sufficiently positioned away from the recording elements to facilitate cleaning of the recording elements by the cleaning assembly without damaging the shift register stages; and providing bond pads on am external surface of the printhead so that to bond pads are sufficiently positioned laterally to said one side and away from the recording elements to facilitate cleaning of the recording elements without interference with electrical connecting elements attached to the bond pads.

17. The method of claim 16 and wherein each recording element is a nozzle on an ink jet printhead.

* * * * *

UNITED STATES PATENT AND TRADEMARK OFFICE

CERTIFICATE OF CORRECTION

PATENT NO. : 6,712,451 B2
DATED : March 30, 2004
INVENTOR(S) : David A. Johnson et al.

It is certified that error appears in the above-identified patent and that said Letters Patent is hereby corrected as shown below:

Column 13,
Line 39, delete “Pads” and insert -- pads --

Column 14,
Line 63, delete “to” and insert -- the --

Column 15,
Line 4, delete “resister” and insert -- register --
Line 6, insert -- , -- after “actuator”
Line 13, delete “resister” and insert -- register --
Line 16, delete “resister” and insert -- register --
Line 21, insert -- at -- after “comprises”
Line 25, insert -- the -- after “and”
Line 28, delete “wit” and insert -- with --
Line 29, delete “Beater” and insert -- heater --
Line 32, delete “ranged” and insert -- arrange --

Column 16,
Line 19, delete “states” and insert -- stages --
Line 22, delete “stare” and insert -- stage --
Line 32, delete “am” and insert -- an --
Line 33, delete “to” and insert -- the --

Signed and Sealed this

Nineteenth Day of October, 2004

JON W. DUDAS
*Director of the United States Patent and Trademark Office*